US005909110A

United States Patent [19]

Yuan et al.

[11] Patent Number: 5,909,110

[45] Date of Patent: Jun. 1, 1999

[54] INTEGRATED VOLTAGE REGULATOR CIRCUIT WITH VERTICAL TRANSISTOR

[75] Inventors: Han-Tzong Yuan, Dallas; Albert H. Taddiken, Farmersville; Donald L. Plumton, Dallas; Jau-Yuann Yang, Richardson, all of Tex.

[73] Assignee: Texas Insturments Incorporated, Dallas, Tex.

[21] Appl. No.: 08/989,840

[22] Filed: Dec. 12, 1997

Related U.S. Application Data

[60] Provisional application No. 60/033,109, Dec. 17, 1996.

[51] Int. Cl.[6] ..... G05F 1/40

[52] U.S. Cl. ..... 323/282

[58] Field of Search ..... 323/274, 282, 323/284

[56] References Cited

U.S. PATENT DOCUMENTS

| | | | |
|---|---|---|---|
| 5,468,661 | 11/1995 | Yuan et al. | 437/40 |
| 5,612,563 | 3/1997 | Fitch et al. | 257/329 |
| 5,736,843 | 4/1998 | Amin | 323/282 |
| 5,811,962 | 9/1998 | Ceccherelli et al. | 323/282 |
| 5,825,163 | 10/1998 | Pontarollo | 323/222 |

OTHER PUBLICATIONS

Numann, Power Management Solutions and Technologies for Evolving Sub 3–V Systems, Power '95, Oct. 18, 1995.

Niemela, et al., Comparison of GaAs and Silicon Synchronous Rectifiers, IEEE 1996 Power Electronics Specialists Conf.

R.L. Kollman, et al., 10 MHz PWM Converters With GaAs VFETs.

*Primary Examiner*—Stuart N. Hecker
*Attorney, Agent, or Firm*—Christopher L. Maginniss; W. James Brady III; Richard L. Donaldson

[57] ABSTRACT

A voltage regulator (10) comprising a vertical channel transistor (12). The vertical channel transistor (12) may have a gate (16), a voltage input terminal (18), and a voltage output terminal (20). A reference voltage supply (14) may be coupled to the gate (16).

20 Claims, 2 Drawing Sheets

INTEGRATED VOLTAGE REGULATOR CIRCUIT WITH VERTICAL TRANSISTOR

This application claims priority under 35 USC § 119(e) (1) of provisional application No. 60/033,109 filed Dec. 17, 1996.

TECHNICAL FIELD OF THE INVENTION

This invention relates generally to the field of electronic devices, and more particularly to an integrated voltage regulator circuit and to a method of forming the same.

BACKGROUND OF THE INVENTION

Many electronic circuits acquire a relatively constant voltage source to operate properly. Such circuits are typically powered by an energy source such as a main power or a battery. The output voltage of these energy sources may fluctuate substantially. To provide a relatively constant voltage, regulator circuits have been developed that convert the voltage of the energy source to a relatively constant voltage.

Generally, a voltage regulator is a simple circuit that provides a low cost control device for small power supplies or other devices having low current ratings. A regulator circuit typically includes a pass transistor coupled to an error amplifier and a base control unit.

The pass transistor in a regulator acts as an adjustable resistor where the voltage difference between the input and the desired output appears across the transistor and causes power losses in the transistor. The desired output may be provided to the transistor by the base control unit which receives input from the error amplifier. The error amplifier may measure output voltage of the transistor against a reference voltage.

Voltage regulators generally suffer a fixed "drop off" voltage induced by the pass transistor. Drop off voltage is the minimum voltage difference between the input and the output voltages of the regulator necessary to maintain output regulation. Accordingly, regulators cannot regulate to the supply voltage.

SUMMARY OF THE INVENTION

Accordingly, a need has arisen in the art for an improved regulator circuit. The present invention provides a voltage regulator circuit that substantially reduces or eliminates the disadvantages and problems associated with prior regulator circuits.

In accordance with the present invention, a voltage regulator may comprise a depletion mode vertical channel transistor as the pass transistor. The vertical channel transistor may have a gate for voltage control terminal, a drain for voltage input terminal, and a source for voltage output terminal. An error voltage measuring the difference between the output voltage and a reference voltage may be coupled to the gate.

More specifically, in accordance with one embodiment of the present invention, the error voltage supply may comprise a voltage clamping device as the reference voltage and a resistive element as the error voltage generator. The voltage clamping device may be coupled to a ground. The resistive element may be coupled between an output voltage terminal and the voltage clamping device. In this embodiment, the voltage clamping device may comprise a series of diodes and the resistive element may comprise a single resistor. The output voltage terminal may be the source of the vertical channel transistor.

Important technical advantages of the present invention include providing voltage regulation that substantially reduces or eliminates "drop off" voltage. In particular, a depletion mode vertical channel pass transistor coupled to an error voltage supply may be employed as a linear regulator circuit. The depletion mode vertical transistor has a short circuit characteristic when the error voltage approaches zero. Accordingly, the improved regulator circuit may be regulated to its supply voltage.

Another technical advantage of the present invention includes providing an integrated regulator circuit. In particular, the vertical channel transistor and the simple error voltage supply may be fabricated on a single integrated circuit chip. Accordingly, the regulator circuit is compact and relatively low cost.

Other technical advantages will be readily apparent to one skilled in the art from the following figures, descriptions, and claims.

BRIEF DESCRIPTION OF THE DRAWINGS

For a more complete understanding of the present invention and its advantages thereof, reference is now made to the following description taken in conjunction with the accompanying drawings, wherein like reference numerals represent like parts, in which.

DETAILED DESCRIPTION OF THE INVENTION

Figure 1:
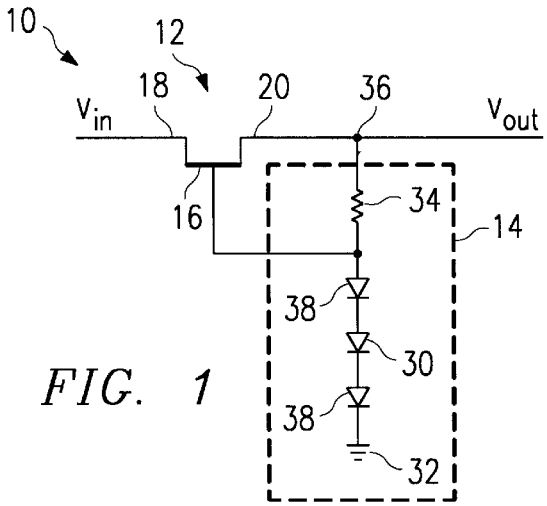
FIG. 1 illustrates a simplified circuit schematic of a voltage regulator circuit constructed in accordance with one embodiment of the present invention.

The preferred embodiments of the present invention and its advantages are best understood by referring now in more detail to FIGS. 1–3 of the drawings, in which like numerals refer to like parts throughout the several views. FIGS. 1–3 illustrate an integrated voltage regulator circuit that substantially reduces or eliminates voltage drop off.

FIG. 1 illustrates a linear regulator circuit 10 constructed in accordance with one embodiment of the present invention. The regulator circuit 10 may include a vertical channel transistor 12 and a reference voltage supply 14. The vertical channel transistor 12 may include a gate terminal 16, a voltage input terminal 18, and a voltage output terminal 20. The voltage input terminal 18 may be a drain of the vertical channel transistor 12 while the voltage output terminal 20 may be a source of the vertical channel transistor 12. The input terminal 18 may receive a voltage input, labeled $V_{in}$, with transient fluctuations from a battery or other power source (not shown). As described in more detail below, the gate terminal 16 may regulate the input voltage with the aid of the reference voltage supply 14 to provide an output voltage, labeled $V_{out}$, at the output terminal 20 that is suitable for a wide range of loads (not shown). The load may be, for example, a cellular telephone or any other electronic device that is powered by a battery.

The reference voltage supply 14 may include a voltage clamping device 30 coupled to a ground potential 32 and a resistive element 34 coupled between a voltage supply 36 and the voltage clamping device 30. In one embodiment, the voltage supply 36 may be the voltage output terminal 20. In this embodiment, as shown by FIG. 1, the gate terminal 16 may be coupled to the voltage output terminal 20 through the resistive element 34. It will be understood that the voltage supply 36 may be other than the voltage output terminal 20.

The voltage clamping device 30 may include a series of diodes 38 comprising one or more individual diodes. In this embodiment, the diodes 38 set the reference voltage for the gate terminal 16. The reference voltage is the cumulative voltage drop across the diodes 38. It will be understood that the voltage clamping device may comprise other types of voltage clamping components capable of setting a reference voltage for the gate terminal 16.

The resistive element 34 may conduct enough current to drop voltage of the voltage supply 36 to the reference voltage at the voltage clamping device 30 while supplying current to operate the voltage clamping device 30. In one embodiment, the resistive element 34 may be a resistor. It will be understood that the resistive element may comprise other components capable of dropping voltage to the reference voltage at the voltage clamping device 30 while supplying current to the voltage clamping device 30.

In operation, a controlling voltage of the vertical channel transistor 12 may be measured between the gate terminal 16 and the source, which is the voltage output terminal 20. In response to a voltage difference between the reference voltage at the gate terminal 16 and the output voltage at the output terminal 20, resistance of the vertical channel transistor 12 between the input and output terminals 18 and 20 may be adjusted to conform the output voltage to the reference voltage. The vertical channel transistor 12 may include a gain bias to respond to small voltage differences. The resistance of the vertical channel transistor may be adjusted by adjusting a potential barrier of the gate terminal 16. Further information concerning vertical effect transistors may be found in U.S. Pat. No. 5,468,661, entitled "Method of Making Power VFET Device," issued Nov. 21, 1995 to Yuan, et al., which is hereby incorporated by reference.

Figure 2A:
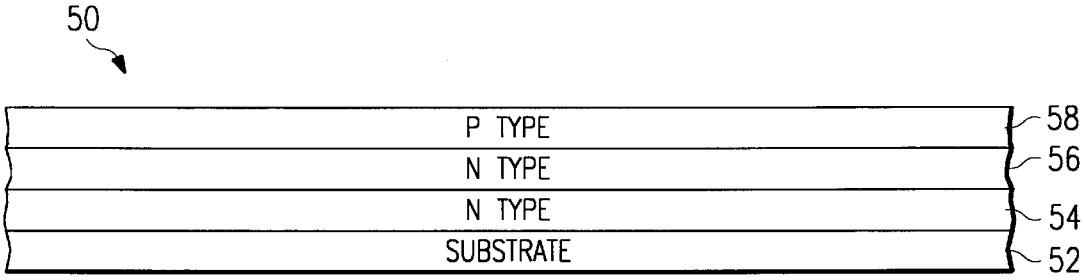
FIGS. 2A–C are a series of schematic cross-sectional diagrams illustrating fabrication of the voltage regulator circuit of FIG. 1 in accordance with one embodiment of the present invention.
Figure 2B:
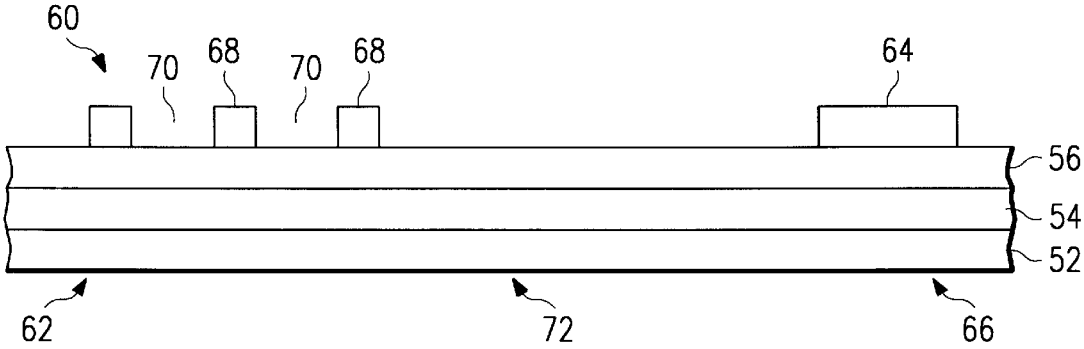
Figure 2C:
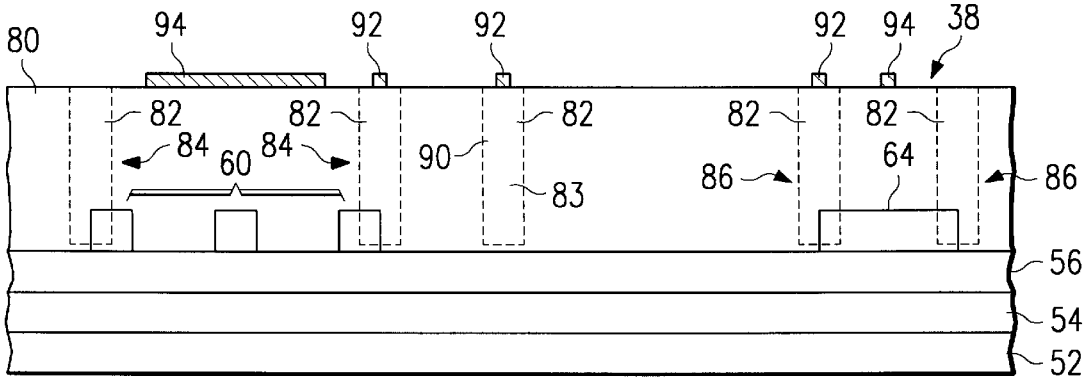

FIGS. 2A–2C illustrate construction of the voltage regulator circuit 10 in accordance with one embodiment of the present invention. In this embodiment, the integrated regulator circuit may be a one (1) amp design formed on a 23 mil by 23 mil chip. The reference voltage supply 14 may include a series of diodes 38 coupled to the ground potential 32 and a resistor coupled between the voltage output terminal 20 of the vertical channel transistor 12 and the diodes 38.

Referring to FIG. 2A, an initial semiconductor structure 50 may have a substrate 52, a first layer of semiconductor material 54, and a second layer of semiconductor material 56. The substrate 52 may comprise III-V type semiconductor material. In one embodiment, the semiconductor material may be gallium arsenide (GaAs). It will be understood that the substrate 52 may comprise other types of semiconductor material within the scope of the present invention.

The substrate 12 may be of a first conductive type. In one embodiment, the first conductive type may be an n-type semiconductor material. In this embodiment, the substrate 52 may be doped with an n-type dopant such as antimony or Si. It will be understood that the dopant and the dopant level of the substrate 52 may vary within the scope of the present invention.

The first semiconductor layer 54 may be formed on the substrate 52. In one embodiment, the first semiconductor layer 54 may be an epitaxial layer conventionally deposited on the substrate 52. The first semiconductor layer 54 may have a thickness of about 0.5 mm. It will be understood that the thickness of the first semiconductor layer 54 may vary within the scope of the present invention.

The first semiconductor layer 54 may comprise III-V type semiconductor material. In one embodiment, the semiconductor material may be gallium arsenide (GaAs). It will be understood that the first semiconductor layer 54 may comprise other types of semiconductor material within the scope of the present invention.

The first semiconductor layer 54 may be of the first conductive type. As previously discussed, the first conductive type may be n-type semiconductor material. In this embodiment, the first semiconductor layer 54 may be doped with an n-type dopant such as Si or Sb. The first semiconductor layer 54 may be doped to generally an n+ level. It will be understood that the dopant and the dopant level of the first semiconductor layer 54 may vary within the scope of the present invention.

The second semiconductor layer 56 may be formed on the first semiconductor layer 54. In one embodiment, the second semiconductor layer 56 may be an epitaxial layer conventionally deposited on the first semiconductor layer 54. The second semiconductor layer 56 may have a thickness of about 1 mm. It will be understood that the thickness of the second semiconductor layer 56 may vary within the scope of the present invention.

The second semiconductor layer 56 may comprise III-V type semiconductor material. In one embodiment, the semiconductor material may be gallium arsenide (GaAs). It will be understood that the second semiconductor layer 56 may comprise other types of semiconductor material within the scope of the present invention.

The second semiconductor layer 56 may be of the first conductive type. As previously discussed, the first conductive type may be n-type semiconductor material. In this embodiment, the second semiconductor layer 56 may be doped with an n-type dopant such as Si or Sb. It will be understood that the dopant and dopant level of the second semiconductor layer 56 may vary within the scope of the present invention.

A gate layer 58 may be formed on the second semiconductor layer 56. In one embodiment, the gate layer 58 may be an epitaxial layer conventionally deposited on the second semiconductor layer 56. The gate layer 58 may be about 4,000 angstroms thick or thicker to reduce gate resistance. It will be understood that the thickness of the gate layer 58 may vary within the scope of the present invention.

The gate layer 58 may comprise III-V type semiconductor material. In one embodiment, the gate layer 58 may comprise gallium arsenide (GaAs). It will be understood that the gate layer 58 may comprise other types of semiconductor material within the scope of the present invention.

The gate layer 58 may be of a second conductive type. In one embodiment, the second conductive type may be p-type semiconductor material. In this embodiment, the gate layer 58 may be heavily doped with carbon to a concentration of about $10^{20}$ $cm^{-3}$ or higher. Generally, the higher the dopant concentration, the lower the gate resistance and the faster the switching of the vertical channel transistor 12. It will be understood that the dopant level may vary within the scope of the present invention. For example, the gate layer 58 may be doped to a lower concentration such as $10^{18}$ $cm^{-3}$.

Referring to FIG. 2B, the gate layer 58 may be conventionally patterned and etched to define a gate structure 60 over a transistor region 62 of the semiconductor structure and a base structure 64 over a diode region 66 of the semiconductor device. The gate structure 60 may comprise a plurality of gates 68 separated by channels 70. In one embodiment, the gates 68 may have a one (1) micron pitch with a channel opening of one-half (0.5) microns. It will be understood that the geometry of the gates 68 and the channels 70 may vary within the scope of the present invention. The gate layer 58 may be completely removed over a resistor region 72. As described in more detail below, an n-well for a resistor may be formed in the resistor region 72.

In one embodiment, the gate layer etch may be a conventional chlorine etch containing plasma that is compatible with gallium arsenide (GaAs) semiconductor material. It will be understood that the other types of etches capable of etching the gate layer 58 may be used within the scope of the present invention.

Referring to FIG. 2C, a third semiconductor layer 80 may be formed on the second semiconductor layer 56, the gate structure 60 and the base structure 64. In one embodiment, the third semiconductor layer 80 may be a conventionally deposited epitaxial layer. The third semiconductor layer 80 may have a thickness of about 1 mm. It will be understood that the thickness of the third semiconductor layer 80 may vary within the scope of the present invention.

The third semiconductor layer 80 may comprise III-V type semiconductor material. In one embodiment, the third semiconductor layer 80 may comprise gallium arsenide (GaAs). It will be understood that the third semiconductor layer 80 may comprise other types of semiconductor material within the scope of the present invention.

The third semiconductor layer 80 may be of the first conductive type. As previously described, the first conductive type may be an n-type semiconductor material. In this embodiment, the third semiconductor layer 80 may be doped with an n-type dopant such as silicon or antimony. It will be understood that the dopant and the dopant level of the third semiconductor layer 80 may vary within the scope of the present invention.

A plurality of p+ implants 82 may be formed in the third semiconductor layer 80. The p+ implant may be Beryllium (Be), zinc (Zn), magnesium (Mg), or the like. A first p+ implant 84 may isolate a perimeter of the vertical field effect transistor 12. The first p+ implant 84 may also connect a top gate contact with the source, here the third semiconductor layer 80.

Over the diode region 66, a second p+ implant 86 may provide isolation for a diode 38. The second p+ implant 86 may extend from a surface of the third semiconductor layer 80 to the base structure 64. It will be understood that other types of diodes may be used within the scope of the present invention. For example, Schottky diodes may be used within the scope of the present invention. Schottky diodes may require additional processing steps during fabrication of the regulator circuit 10.

Over the resistor region 72, a third p+ implant 88 may act as a resistor 90. For a one (1) amp design, the third p+ implant 88 may result in a 500 to 600 ohm per square resistor. It will be understood to one skilled in the art that the resistance of the resistor 90 may vary depending on the specific design of the regulator circuit 10. It will be further understood that the resistor 90 may be fabricated in the gate level 80 for a lower sheet resistance. Additionally, resistor 90 could be formed in a n− source epilayer.

P-ohmic contacts 92 and n-ohmic contacts 94 may be conventionally formed for the vertical field effect transistor 12, diodes 38 and resistor 90. The p-ohmic contacts 92 may be AuZn, TiPtAu to a Zn diffused region, or the like. The n-ohmic contacts 94 may be PdGeIn, AuGeNi, PdGe, InGaAs with TiPtAu, InGaAs with WSi, or the like. Further information concerning formation of the vertical field effect transistor 12, p+ implants 82 and contacts 92 and 94 may be found in U.S. Pat. No. 5,468,661, issued to Yuan, et al., previously incorporated by reference.

Figure 3A:
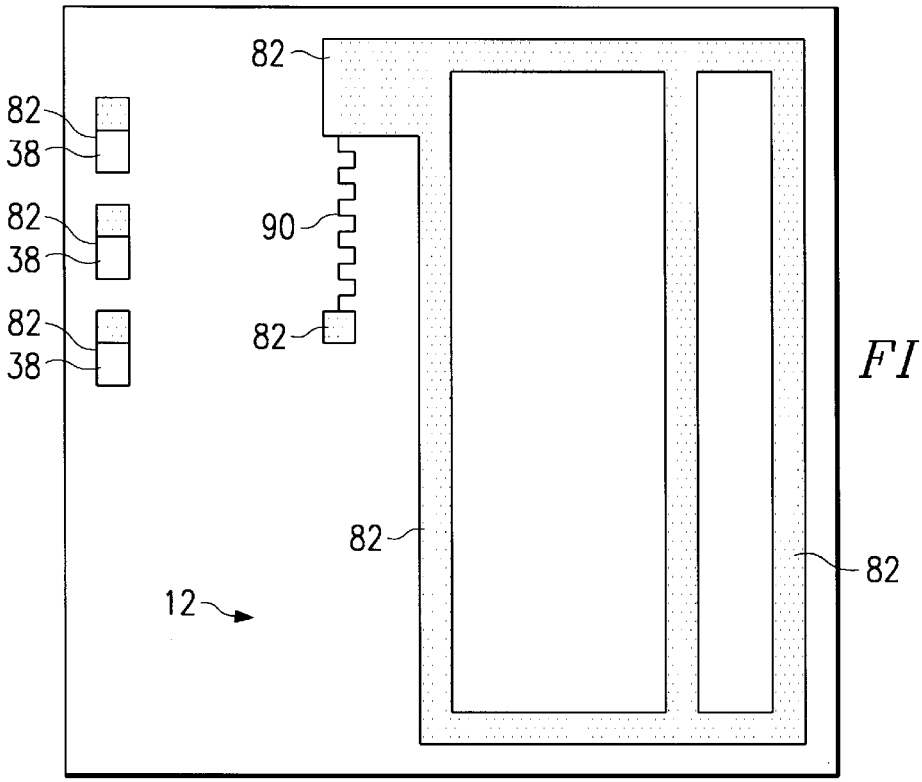
FIGS. 3A–B are a series of top plan views illustrating the layout of the voltage regulator circuit of FIG. 1 on an integrated circuit chip in accordance with one embodiment of the present invention.
Figure 3B:
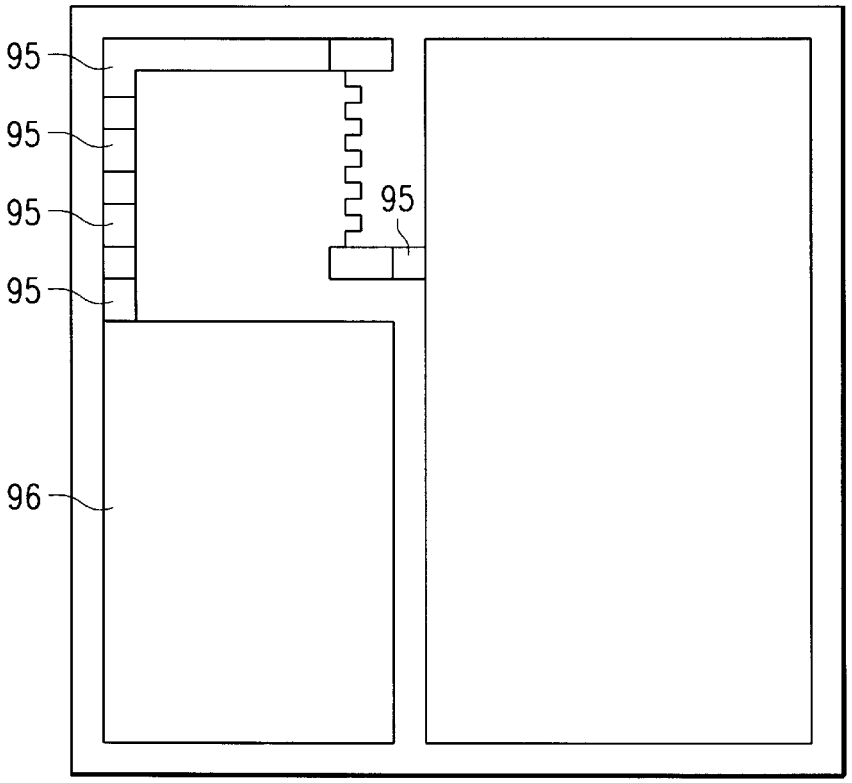

FIGS. 3A–B illustrate a top plan view of the layout of the integrated regulator circuit 10 in accordance with one embodiment of the present invention. As previously described, the integrated regulator circuit 10 may be formed on a 23 mil by 23 mil chip.

Referring to FIG. 3A, the p+ implants 82 provide isolation for the diodes 38 and the vertical field effect transistor 12. Additionally, the p+ implants 82 may couple the gate terminal 16 of the vertical field effect transistor 12 to the resistor 90. Accordingly, a metal layer or other type of contact need not be used for the connection.

Referring to FIG. 3B, a metal layer may be deposited, patterned and etched to form contacts 95 between the voltage output terminal 20 of the field effect transistor 12 and the resistor 90, the resistor 90 and the diodes 38, between the diodes 38, and between the diodes 38 and a ground pad 96. The ground pad 96 may be coupled to the ground potential 32, which may be external to the chip.

Although the present invention has been described with several embodiments, various changes and modifications may be suggested to one skilled in the art. It is intended that the present invention encompass such changes and modifications as fall within the scope of the appended claims.

What is claimed is:

1. A voltage regulator, comprising:

a vertical channel transistor having a gate, a voltage input terminal, and a voltage output terminal; and a reference voltage supply coupled to the gate.

2. The voltage regulator of claim 1, the reference voltage supply further comprising a voltage clamping device coupled to a ground and a resistive element coupled between a voltage supply and the voltage clamping device.

3. The voltage regulator of claim 1, the reference voltage supply further comprising a diode coupled to a ground and a resistive element coupled between a voltage supply and the diode.

4. The voltage regulator of claim 3, the resistive element further comprising a resistor.

5. The voltage regulator of claim 1, the reference voltage supply further comprising a diode coupled to a ground and a resistive element coupled between the voltage output terminal of the vertical channel transistor and the diode.

6. The voltage regulator of claim 1, the voltage input terminal further comprising a drain of the vertical channel transistor.

7. The voltage regulator of claim 1, the voltage output terminal further comprising a source of the vertical channel transistor.

8. An integrated circuit chip, comprising:

a vertical channel transistor formed on a semiconductor layer;

the vertical channel transistor having a gate, a voltage input terminal, and a voltage output terminal;

a reference voltage supply formed on the semiconductor layer; and the reference voltage supply coupled to the gate.

9. The integrated circuit chip of claim 8, the reference voltage supply further comprising:

a voltage clamping device formed on the semiconductor layer;

the voltage clamping device coupled to a ground;

a resistive element formed on the semiconductor layer; and the resistive element coupled between a voltage supply and the voltage clamping device.

10. The voltage regulator of claim 8, the reference voltage supply further comprising:

a diode formed on the semiconductor layer;

the diode coupled to a ground;

a resistive element formed on the semiconductor layer; and the resistive element coupled between a voltage supply and the diode.

11. The voltage regulator of claim 8, the resistive element further comprising a resistor.

12. The voltage regulator of claim 8, the reference voltage supply further comprising:

a diode formed on the semiconductor layer;

the diode coupled to a ground;

a resistive element formed on the semiconductor layer; and the resistive element coupled between the voltage output terminal of the vertical channel transistor and the diode.

13. The voltage regulator of claim 8, the voltage input terminal further comprising a drain of the vertical channel transistor.

14. The voltage regulator of claim 8, the voltage output terminal further comprising a source of the vertical channel transistor.

15. A method of regulating voltage, comprising:

receiving an input voltage at a voltage input terminal of a vertical channel transistor;

receiving an output voltage at a voltage output terminal of the vertical channel transistor;

supplying a reference voltage at a gate of the vertical channel transistor; and in response to a voltage difference between the reference voltage at the gate and the output voltage at the voltage output terminal, adjusting with the gate a resistance between the voltage input terminal and the voltage output terminal to conform the output voltage at the voltage output terminal to the reference voltage at the gate.

16. The method of claim 15, wherein the voltage disparity is measured by a resistive element coupled between the gate and the voltage output terminal.

17. The method of claim 15, wherein the voltage disparity is measured by a resistor coupled between the gate and the voltage output terminal.

18. The method of claim 16, wherein the reference voltage is supplied to the gate by a voltage clamping device coupled to a ground and to the resistive element.

19. The method of claim 16, wherein the reference voltage is supplied to the gate by a series of diodes coupled to a ground and to the resistive element.

20. The method of claim 16, wherein the voltage input terminal is a drain of the vertical channel transistor and the voltage output terminal is a source of the vertical channel transistor.

* * * * *